US008850805B2

(12) United States Patent
Riekers et al.

(10) Patent No.: US 8,850,805 B2
(45) Date of Patent: Oct. 7, 2014

(54) EXHAUST MANIFOLD

(75) Inventors: Ralf Riekers, Stuttgart (DE); Michael Weiss, Pluderhausen (DE)

(73) Assignee: J. Eberspaecher GmbH & Co. KG, Esslingen (DE)

( * ) Notice: Subject to any disclaimer, the term of this patent is extended or adjusted under 35 U.S.C. 154(b) by 9 days.

(21) Appl. No.: 13/533,644

(22) Filed: Jun. 26, 2012

(65) Prior Publication Data

US 2012/0266588 A1 Oct. 25, 2012

Related U.S. Application Data

(63) Continuation of application No. 12/336,956, filed on Dec. 17, 2008, now Pat. No. 8,230,680.

(30) Foreign Application Priority Data

Dec. 24, 2007 (DE) ..... 10 2007 062 660

(51) Int. Cl.
*F01N 1/00* (2006.01)
*F01N 13/18* (2010.01)
*F01N 13/10* (2010.01)

(52) U.S. Cl.
CPC ..... *F01N 13/102* (2013.01); *F01N 13/1827* (2013.01); *F01N 13/10* (2013.01); *F01N 2450/24* (2013.01); *F01N 13/1838* (2013.01); *F01N 13/107* (2013.01)
USPC ..... 60/323; 60/321; 60/322; 285/124.1

(58) Field of Classification Search
CPC ..... F01N 13/102; F01N 13/1827; F01N 13/1838; F01N 13/10; F01N 13/107; F01N 2450/24
USPC ..... 60/274–324
See application file for complete search history.

(56) References Cited

U.S. PATENT DOCUMENTS 4,184,329 A * 1/1980 Ruesch ..... 60/322
5,596,961 A * 1/1997 Faber ..... 123/184.38

(Continued)

FOREIGN PATENT DOCUMENTS

DE 27 42 296 A1 4/1978
DE 31 29 351 A1 2/1983

(Continued)

OTHER PUBLICATIONS

Opposition Brief (with English translation), received in the German priority, which reflects the opponent's opinion only and in no way should be regarded as an official statement from the German Patent Office. The opposition proceedings are still pending. Date of Brief Apr. 28, 2011.

*Primary Examiner* — Jesse Bogue
(74) *Attorney, Agent, or Firm* — Reinhart Boerner Van Deuren P.C.

(57) ABSTRACT

The present invention relates to an exhaust manifold for an internal combustion engine, in particular in a motor vehicle, comprising a housing from which a plurality of inlet pipes emanate, which, in the built-in state, lead to cylinders of the internal combustion engine, and comprising a flange, which is welded to the inlet pipes and which, in the built-in state, is screwed to the cylinder head of the internal combustion engine by means of a screw connection. The fatigue strength of the exhaust manifold can be improved by subdividing the flange into at least two partial flanges in a longitudinal direction of the exhaust manifold.

13 Claims, 2 Drawing Sheets

(56) References Cited

U.S. PATENT DOCUMENTS

| | | | | |
|---|---|---|---|---|
| 5,829,794 | A | 11/1998 | Schulz-Hausmann et al. | |
| 5,887,428 | A | 3/1999 | Garisto | |
| 5,918,912 | A | 7/1999 | Keifel et al. | |
| 6,155,045 | A | 12/2000 | Dürr et al. | |
| 6,247,552 | B1 * | 6/2001 | Kovar et al. | 181/240 |
| 6,555,070 | B1 | 4/2003 | Krüger | |
| 6,604,358 | B2 | 8/2003 | Dürr et al. | |
| 6,789,386 | B1 | 9/2004 | Haerle | |
| 7,185,490 | B2 * | 3/2007 | Smatloch et al. | 60/323 |
| 7,578,124 | B2 * | 8/2009 | Diez et al. | 60/323 |
| 2005/0072143 | A1 | 4/2005 | Diez | |
| 2006/0279047 | A1 | 12/2006 | Bien et al. | |
| 2009/0158723 | A1 | 6/2009 | Riekers et al. | |

FOREIGN PATENT DOCUMENTS

| | | | | | |
|---|---|---|---|---|---|
| DE | 42 26 171 | A1 | | 2/1994 | |
| DE | 103 59 062 | A1 | | 7/2005 | |
| DE | 10 2005 025 735 | B3 | | 9/2006 | |
| EP | 0178430 | A1 | | 4/1986 | |
| EP | 0918148 | A2 | | 5/1999 | |
| EP | 1 291 500 | A2 | | 3/2003 | |
| JP | 8338240 | A | | 12/1996 | |
| JP | 09088577 | A | * | 3/1997 | F01N 7/10 |
| JP | 2001 263054 | A | | 9/2001 | |
| JP | 2007 023849 | A | | 2/2007 | |
| JP | 2007023849 | A | * | 2/2007 | |
| WO | WO 2005/005801 | A1 | | 1/2005 | |

* cited by examiner

EXHAUST MANIFOLD

CROSS-REFERENCE TO RELATED PATENT APPLICATIONS

This patent application is a continuation of U.S. patent application Ser. No. 12/336,956, filed Dec. 17, 2008, which is now pending, and claims the benefit of German Patent Application No. 102007062660.8, filed Dec. 24, 2007, the entire teachings and disclosure of which are incorporated herein by reference thereto.

FIELD OF THE INVENTION

The present invention relates to an exhaust manifold for an internal combustion engine, in particular in a motor vehicle.

BACKGROUND OF THE INVENTION

Such an exhaust manifold, which in principle can also be designated as an exhaust plenum chamber, is known, for example, from DE 10 2005 025 735 B3 and comprises a housing from which a plurality of inlet pipes emanate, which, in the built-in state, lead to cylinders of the internal combustion engine and a flange, which is welded to the inlet pipes and which, in the built-in state, is screwed to the cylinder head of the internal combustion engine by means of screws. The known exhaust manifold is further configured as an air-gap-isolated exhaust manifold, whose housing together with the inlet pipes is formed by an inner shell and an outer shell, which are both welded to the flange and between which an isolating air gap is formed.

During operation of an internal combustion engine, the exhaust manifold frequently reaches significantly higher temperatures than the cylinder head. This leads to different thermal expansions, which is clearly noticeable particularly in a longitudinal direction of the exhaust manifold, especially in in-line engines having four or more cylinders.

In principle, it is possible to design the screw connection of the flange to the cylinder head in such a manner that a thermally induced relative movement between flange and cylinder head is minimized. In this case, however, extreme stresses are formed in the housing, which can comparatively rapidly lead to fatigue or even to rupture of the material. Likewise, it is fundamentally possible to configure the screw connection in such a manner that the flange can move in a thermally induced manner comparatively freely relative to the cylinder head, i.e., it can slide in a contact plane between flange and cylinder head. As a result, a relative change in position between the inlet pipes and the cylinders comes about, which is disadvantageous for the sealing and unfavorable for the flow conditions.

BRIEF SUMMARY OF THE INVENTION

Embodiments of the present invention are concerned with the problem of providing an improved embodiment for an exhaust manifold of the type specified initially, which is particularly characterized in that a sufficient sealing effect can be achieved during operation of the internal combustion engine, while at the same time, a longer lifetime should be achieved for the exhaust manifold.

Embodiments of the invention are based on the general idea of dividing the flange in a longitudinal direction of the exhaust manifold. The "longitudinal direction" of the exhaust manifold in this case is the direction in which the inlet pipes are arranged adjacent to one another or behind one another.

Due to the longitudinal division of the flange, two partial flanges are formed, which can vary their length independently of one another in a thermally induced manner. By this means, the longitudinal expansion of the individual partial flange is reduced with regard to its absolute value. The thermal loading of the housing can be reduced accordingly in conjunction with a screw connection, which allows sliding in the flange plane. The respective division of the flange is thereby achieved by a gap, which extends transversely to the longitudinal direction and which provides a predetermined gap width in the longitudinal direction between neighboring partial flanges at ambient temperature, which can diminish accordingly with increasing temperature.

Particularly advantageous is an embodiment in which at least one reinforcing plate is provided, which reinforcing plate abuts flat against the flange on a side facing the housing, which bridges at least one gap formed by the subdivision between two neighboring partial flanges, and which, in the built-in state, is screwed to the cylinder head by means of the screw connection, in such a manner that the flange is disposed between the respective reinforcing plate and the cylinder head. Due to the respective reinforcing plate, the pressing of the partial flanges onto the cylinder head can be improved in the built-in state so that the respective reinforcing plate counteracts any lifting, bending, or buckling of the flange. In this design, in the screw connection in the built-in state, screw heads or nuts are no longer supported on the flange but on the respective reinforcing plate so that the flange is pressed against the cylinder head with the aid of the respective reinforcing plate. Furthermore, the reinforcing plate effects a guidance of the relative movement between flange and cylinder head in the flange plane. Furthermore, the respective reinforcing plate prevents screw heads or nuts from being embedded in the flange, which promotes the displaceability of the flange or the partial flanges in the flange plane despite the screw connection.

In an advantageous further development, the respective reinforcing plate can at least contain one through opening through which at least one inlet pipe passes. This design has the result that the respective reinforcing plate achieves pressing of the flange in the area of the respective inlet pipe which is as uniform as possible.

Further important features and advantages of the invention are obtained from the dependent claims, from the drawings, and from the relevant description of the figures with reference to the drawings.

It is understood that the aforesaid features and those explained hereinafter may be used not only in the respectively given combination but also in other combinations or alone, without departing from the scope of the present invention.

Other aspects, objectives and advantages of the invention will become more apparent from the following detailed description when taken in conjunction with the accompanying drawings.

BRIEF DESCRIPTION OF THE DRAWINGS

Preferred exemplary embodiments of the invention are shown in the drawings and are explained in detail in the following description wherein the same reference numerals relate to the same or similar components or those having the same function. In the figures, in each case schematically.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
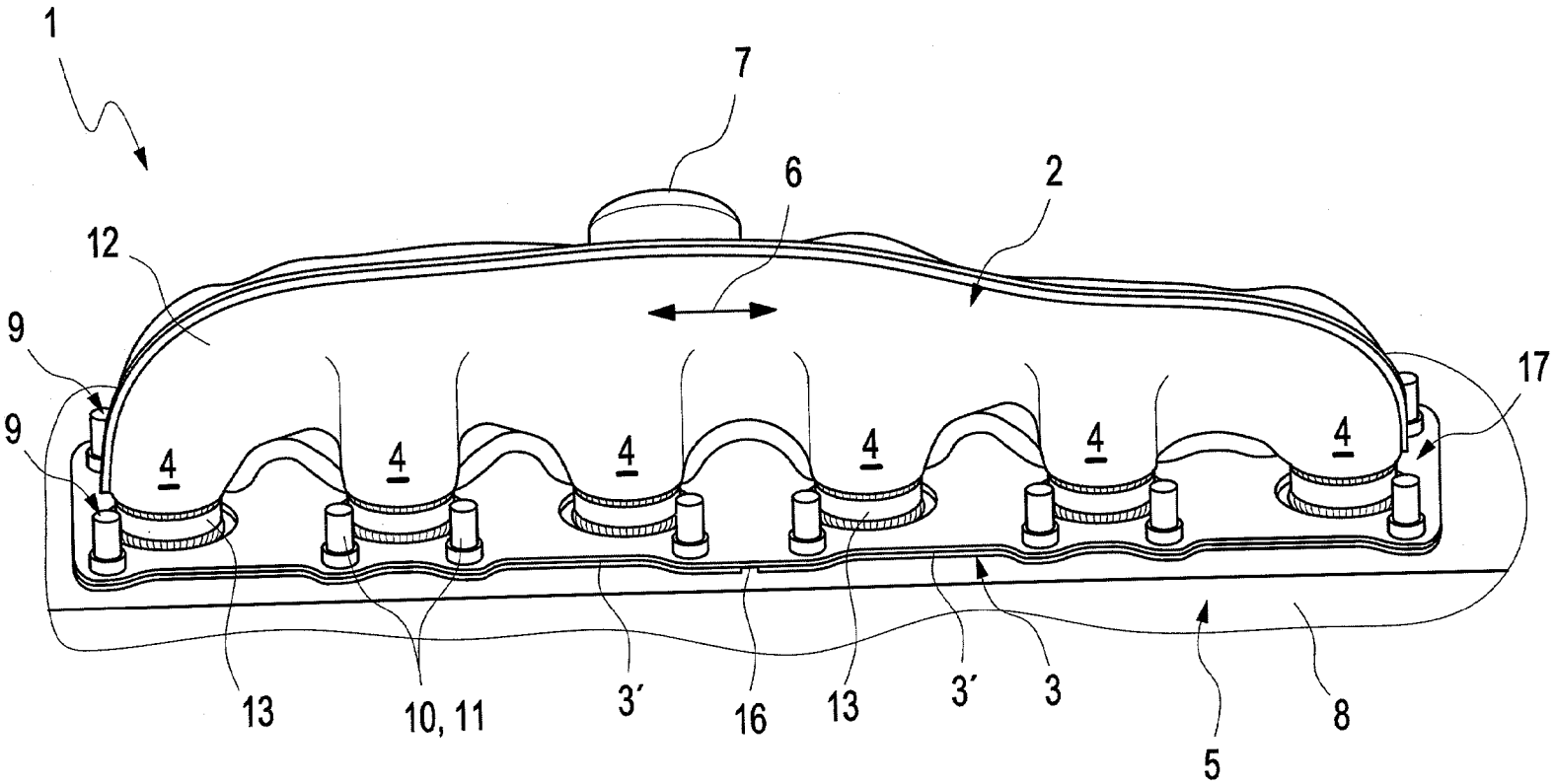
FIG. 1 shows a perspective view of an exhaust manifold in the built-in state.

According to FIG. 1, an exhaust manifold 1 comprises a housing 2 and a flange 3. The housing 2 comprises a plurality of inlet pipes 4, which emanate from the housing 2 or from a collecting chamber formed in the housing 2. In the built-in state shown, the inlet pipes 4 lead to cylinders, not shown, of an internal combustion engine 5 shown only in part. In the example, the internal combustion engine 5 comprises a six-cylinder in-line engine. The inlet pipes 4 are thereby arranged in a direction behind one another or adjacent to one another. This direction defines the longitudinal direction of the exhaust manifold 6, which is indicated by a double arrow and designated by 6. It is clear that the number of inlet pipes 4 reproduced here is to be understood merely as an example so that more or fewer inlet pipes 4 may also be present.

In addition, the housing 2 has at least one outlet pipe 7, by which means in the built-in state, the exhaust manifold 1 is connected to an exhaust system of an internal combustion engine 5, wherein the internal combustion engine 5 can be disposed in particular in a motor vehicle.

The flange 3 is welded to the inlet pipes 4 and in the built-in state, is screwed to a cylinder head 8 of the internal combustion engine 5. The screw connection 9 used in this case consists of a plurality of individual screws 10, of which only the screw heads are visible. Likewise, the screw connection 9 can be formed by a plurality of stud bolts 11, on which nuts are placed.

Figure 2:
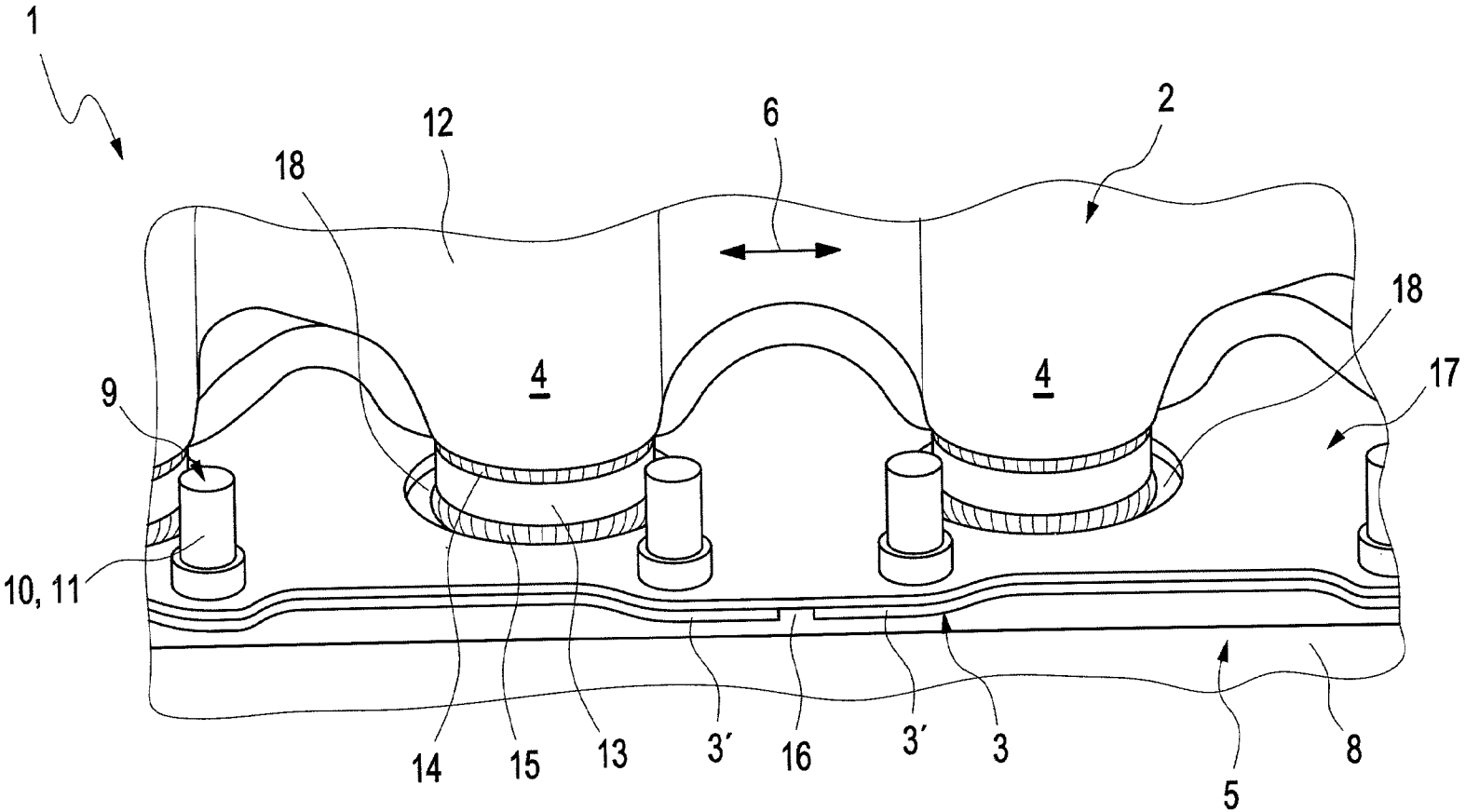
FIG. 2 shows an enlarged detailed view in a central section of the exhaust manifold.

The exhaust manifold 1 can advantageously be configured as an air-gap-isolated exhaust manifold 1. The housing 2 is then formed together with the inlet pipes 4 by an outer shell 12 and an inner shell 13 disposed therein. In the example shown, the inner shell 13 is guided out from the outer shell 12 in the area of the inlet pipes 4 and welded to the outer shell 12 at 14 as in FIG. 2. In this case, the flange 3 is only welded to the inner shell 13 at 15. In another embodiment, it may be provided to also guide the outer shell 12 as far as the flange 3 and additionally weld the outer shell 12 to the flange 3.

According to the invention, the flange 3 is subdivided into at least two partial flanges 3' in the longitudinal direction of the manifold 6. This longitudinal division of the flange 3 is achieved by forming a gap 16, in which the respective partial flanges 3' are separated from one another in the longitudinal direction 6. In the example shown, the gap 16 extends rectilinearly and specifically transversely to the longitudinal direction 6. The gap width of the gap 16 present in the cold exhaust manifold 1 is matched to the predicted longitudinal expansion of the partial flanges 3' adjacent to the gap 16, which effects a reduction in the gap width with increasing temperature.

In the example shown, only a single gap 16 is provided, which subdivides the flange 3 into precisely two partial flanges 3'. It is clear that in principle, two or more gaps 16 or subdivisions can also be provided, so that the flange 3 then consists of three or more partial flanges 3.

In the example shown with precisely two partial flanges 3', the gap 16 is arranged approximately at the centre of the flange 3 in the longitudinal direction 6 of the manifold, so that the flange 3 is divided approximately centrally.

In addition, the exhaust manifold 1 has at least one reinforcing plate 17 which, at least in the built-in state, abuts flat against the flange 3 on a side facing the housing 2. The reinforcing plate 17 is thereby formed in such a manner that it bridges the gap 16 or at least one gap 16. In the built-in state shown, the respective reinforcing plate 17 is screwed onto the cylinder head 8 with the aid of the screw connection 9 in such a manner that it presses the flange 3 against the cylinder head 8. Consequently, the flange 3 is disposed between the respective reinforcing plate 17 and the cylinder head 8. The fixing of the flange 3 on the cylinder head 8 with the aid of the screw connection 9 is therefore not effected directly but indirectly via the respective reinforcing plate 17.

In the example shown, only one single reinforcing plate 17 is provided. In principle, in other embodiments two or more reinforcing plates 17 may also be provided, which may be disposed adjacent to one another in the longitudinal direction 6 of the manifold and/or above one another in the direction of the screw connection running perpendicularly to the flange plane.

In the example, the reinforcing plate 17 has a separate through opening 18 for each inlet pipe 4, through which the respective inlet pipe 4 passes. For the production of the exhaust manifold 1, this means that the respective reinforcing plate 17 is appropriately attached before welding the flange 3 to the housing 2. In this case, the reinforcing plate 17 covers the entire flange 3 undivided. In particular the reinforcing plate 17 is configured congruently to the flange 3 in relation to the direction of the screw connection. The reinforcing plate 17 thus extends over the entire length and/or over the entire width of the flange 3. Furthermore, the reinforcing plate 17 has the same hole pattern for the screw connection 9 with the same or different through holes as the flange 3.

In order to screw the flange 3 indirectly against the cylinder head 8 with the aid of the respective reinforcing plate 17, in the built-in state, the heads of the screws 10 or the nuts of the stud bolts 11 are supported directly on the respective reinforcing plate 17 and are therefore only indirectly via the reinforcing plate 17 on the flange 3.

The flange 3 abuts against the cylinder head 8 in a flange plane. The contouring of flange 3 and cylinder head 8 in this flange plane can in principle be configured in such a manner that in the built-in state, each partial flange 3' fundamentally abuts displaceably in the longitudinal direction 6 on the cylinder head 8. If no screw connection 9 is provided, the partial flanges 3' are freely displaceable relative to the cylinder head 8. When the screw connection 9 is applied, the thermal expansion effects may force the displacement, i.e. a shift of the respective partial flange 3' in the flange plane relative to the cylinder head 8.

In a particular embodiment, in the built-in state, the respective partial flange 3' may be fixed on the cylinder head 8 approximately centrally with respect to the longitudinal direction 6 of the manifold by means of a positive connection which is effective at least in the longitudinal direction 6 of the manifold. This positive connection not shown here has the effect that the respective partial flange 3' can expand in opposite directions parallel to the longitudinal direction 6 of the manifold starting from the position of the positive connection, whereby the relative displacement between the respective partial flange 3' and the cylinder head 8 in the area of the longitudinal ends of the respective partial flange 3' is reduced. Such a positive connection can be achieved, for example, with a tongue and groove configuration.

Because the screw heads or nuts of the screw connection 9 are supported on the respective reinforcing plate 17 and not on the partial flanges 3', the screw heads or nuts cannot be embedded in the flange 3, with the result that the displaceability between the respective partial flange 3' and the cylinder head 8 is improved or made easier.

By dividing the flange 3 in the longitudinal direction 6 of the manifold, the thermally induced expansions may be distributed in a balanced manner on the structure of the exhaust manifold 1, i.e. on the flange 3 and the housing 2, without the sealing between the inlet pipes 4 and the cylinders being severely impaired thereby. At the same time, the at least one reinforcing plate 17 effects a stabilization or stiffening of the flange 3 which counteracts bending or corrugation in the flange 3. As a result, the sealing effect between flange 3 and cylinder head 8 can be improved.

In addition, the reinforcing plate 17 effects a certain thermal insulation of the flange 3 with respect to the housing 2. In particular, the reinforcing plate 17 protects the flange 3 from the direct radiant heat of the housing 2.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An exhaust manifold for an internal combustion engine, in particular in a motor vehicle comprising:

a single housing comprising a plurality of inlet pipes, wherein each one of the plurality of inlet pipes emanate from the single housing, which, in the built-in state, lead to cylinders of the internal combustion engine;

a flange, which is welded to each of the plurality of inlet pipes emanating from the housing and which, in the built-in state, is screwed to the cylinder head of the internal combustion engine by means of a screw connection, the flange is subdivided into at least two partial flanges in a longitudinal direction of the exhaust manifold wherein more than one of the plurality of inlet pipes extends from each of the at least two partial flanges; and at least one reinforcing plate, the reinforcing plate abuts flat against the flange on a side facing the single housing, which bridges at least one gap formed by the subdivision between two neighboring partial flanges, and which, in the built-in state, is screwed to the cylinder head by means of the screw connection, in such a manner that the flange is disposed between the at least one reinforcing plate and the cylinder head;

wherein the at least one reinforcing plate includes a separate through opening for each inlet pipe.

2. The exhaust manifold of claim 1, wherein each inlet pipe passes through the separate through opening of the at least one reinforcing plate.

3. The exhaust manifold of claim 1, wherein in the built-in state, screw heads or nuts of the screw connection are supported on the flange by means of the respective reinforcing plate.

4. The exhaust manifold of claim 1, wherein the flange is divided approximately centrally.

5. The exhaust manifold of claim 1, wherein in the built-in state each partial flange abuts displaceably in the longitudinal direction of the exhaust manifold on the cylinder head.

6. The exhaust manifold of claim 1, wherein the exhaust manifold is configured as an air-gap-isolated exhaust manifold.

7. The exhaust manifold of claim 1, wherein the flange is operably fixedly connected to the single housing by welding, the at least one reinforcing plate being permanently positioned between the flange and the single housing with the inlet pipes passing through the at least one reinforcing plate, such that removal of said at least one reinforcing plate would require destruction of the connection between the single housing and the flange.

8. The exhaust manifold of claim 1, wherein the at least one reinforcing plate has a cross-section shape in a reinforcing plate plane generally orthogonal to a direction of the screw connection that is identical to a cross-sectional shape of the side of the flange facing the single housing against which the at least one reinforcing plate abuts.

9. The exhaust manifold of claim 8, wherein the lengths of the shapes of cross-sectional shapes of the at least one reinforcing plate and the flange are substantially identical and the widths of the shapes of cross-section shapes of the at least one reinforcing plate and the flange are substantially identical.

10. The exhaust manifold of claim 9, wherein the through apertures are larger in size than the inlet pipes.

11. The exhaust manifold of claim 1, wherein adjacent ones of the inlet pipes are spaced apart forming a gap therebetween, the at least one reinforcing plate includes a portion that extends entirely through the gap and completely separating adjacent ones of the through openings from one another.

12. An exhaust manifold for an internal combustion engine, in particular in a motor vehicle comprising:

a single housing comprising a plurality of inlet pipes, wherein each one of the plurality of inlet pipes emanate from the single housing, which, in the built-in state, lead to cylinders of the internal combustion engine;

a flange, which is welded to each of the plurality of inlet pipes emanating from the single housing and which, in the built-in state, is screwed to the cylinder head of the internal combustion engine by means of a screw connection, the flange is subdivided into at least two partial flanges in a longitudinal direction of the exhaust manifold, wherein more than one of the plurality of inlet pipes extends from each of the at least two partial flanges; and a single reinforcing plate, the single reinforcing plate abuts flat against the flange on a side facing the single housing, which bridges at least one gap formed by the subdivision between two neighboring partial flanges, and which, in the built-in state, is screwed to the cylinder head by means of the screw connection, in such a manner that the flange is disposed between the single reinforcing plate and the cylinder head; and wherein the single reinforcing plate covers the flange undivided.

13. The exhaust manifold of claim 12, wherein the single reinforcing plate has a plurality of through openings including a separate through opening for each inlet pipe through which a corresponding one of the inlet pipes passes.

* * * * *